US006010261A

United States Patent [19]

Maekawa

[11] Patent Number: 6,010,261

[45] **Date of Patent: *Jan. 4, 2000**

[54] PRINTER CAPABLE OF DESIGNATING THE TYPE OF RECORDING MEDIUM IN A MEDIUM TRAY

[75] Inventor: Shinichiro Maekawa, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/581,377

[22] Filed: Dec. 29, 1995

[30] Foreign Application Priority Data

Jan. 6, 1995 [JP] Japan ..... 7-016505

[51] Int. Cl.[7] ..... B41J 11/50

[52] U.S. Cl. ..... 400/605; 271/9.03

[58] Field of Search ..... 400/605; 271/9.03

[56] References Cited

U.S. PATENT DOCUMENTS

| | | | |
|---|---|---|---|
| 4,484,734 | 11/1984 | Tsudaka et al. | 271/9.03 |
| 4,763,889 | 8/1988 | Dei et al. | 271/9.03 |
| 5,028,041 | 7/1991 | Kobayashi | 271/9.03 |
| 5,168,316 | 12/1992 | Hino et al. | 271/9.03 |
| 5,584,590 | 12/1996 | Ito et al. | 400/605 |

FOREIGN PATENT DOCUMENTS

| | | | |
|---|---|---|---|
| 5-32335 | 2/1993 | Japan | 400/605 |
| 193769 | 8/1993 | Japan | 400/605 |

*Primary Examiner*—Edgar Burr
*Assistant Examiner*—Charles H. Nolan, Jr.
*Attorney, Agent, or Firm*—Fitzpatrick, Cella, Harper & Scinto

[57] ABSTRACT

In a printer apparatus having an automatic paper feed selection function for automatically selecting one of a plurality of paper feed means in which a paper of a designated size is loaded, an operator is permitted to set a desired priority. When there are a plurality of paper feed means in which the paper of the designated size are loaded, the paper feed means of a higher priority is selected to cause the selected paper feed means to feed the paper for printing. The priority may be set to groups each comprising a plurality of paper feed means. When there are a plurality of paper feed means in one group in which the paper of the designated size are loaded, the paper is fed from predetermined paper feed means. When no paper is loaded in a paper feed cassette of the paper feed means from which the paper is to be fed, one of a plurality of operation modes relating to a timing to inform it may be selected by the operator.

57 Claims, 14 Drawing Sheets

INP/MODE/VALUE OF RANK n

1:PAPER CASSETTE 210
2:PAPER CASSETTE 250
3:PAPER CASSETTE 251
4:PAPER CASSETTE 252
5:MANUAL INSERTION TRAY 219
6:AUTO

FIG. 9A

| | | |
|---|---|---|
| PAPER SIZE | PAP | |
| PAPER FEED MEANS | INP | |
| PAPER FEED MODE | MODE | |
| PRIORITY ORDER | RANK | RANK 1 |
| | | RANK 2 |
| | | RANK 3 |
| | | RANK 4 |
| | | RANK 5 |

FIG. 9B

| | |
|---|---|
| GROUP 1 | RANK 1-1 |
| | RANK 1-2 |
| | RANK 1-3 |
| | RANK 1-4 |
| | RANK 1-5 |
| GROUP 2 | RANK 2-1 |
| | RANK 2-2 |
| | RANK 2-3 |
| | RANK 2-4 |
| | RANK 2-5 |
| GROUP 3 | RANK 3-1 |
| | RANK 3-2 |
| | RANK 3-3 |
| | RANK 3-4 |
| | RANK 3-5 |

FIG. 9C

VALUE OF RANK n

0:NO DESIGNATION
1:PAPER CASSETTE 210
2:PAPER CASSETTE 250
3:PAPER CASSETTE 251
4:PAPER CASSETTE 252
5:MANUAL INSERTION TRAY 219
6:AUTO

11:GROUP 1
12:GROUP 2
13:GROUP 3

| | |
|---|---|
| PAPER CASSETTE 210 | PMODE 1 |
| PAPER CASSETTE 250 | PMODE 2 |
| PAPER CASSETTE 251 | PMODE 3 |
| PAPER CASSETTE 252 | PMODE 4 |
| MANUAL INSERTION TRAY 219 | PMODE 5 |

PRINTER CAPABLE OF DESIGNATING THE TYPE OF RECORDING MEDIUM IN A MEDIUM TRAY

BACKGROUND OF THE INVENTION

1. Field of the Invention

The present invention relates to a printer apparatus capable of feeding paper by a plurality of paper feed means and a printer control apparatus for controlling such a printer apparatus.

2. Related Background Art

Recently, a printer such as a laser beam printer has been widely used as an output device of a computer. Also, various printers having a plurality of paper feed means such as a plurality of paper cassettes or a multi-purpose tray and an automatic paper feed selection function for recognizing paper loaded in the plurality of paper feed means by a printer controller to search the paper feed means in which the paper of a designated size are loaded and for feeding the paper from the paper feed means in which the paper of the required size is loaded have been marketed.

In the printer of this type, when paper in the paper feed means such as a cassette designated from a panel are exhausted, it is displayed to a user. However, no attention is paid to a timing of the display. It includes a mode in which the absence of paper is instantly informed to the user through a panel LCD upon designation (hereinafter referred to as a "instant request mode for lack of paper") and a mode in which the absence of paper is not informed to the user even if the paper is absent until an eject request is received (hereinafter referred to as a "delayed request mode for lack of paper").

In realizing the automatic paper feed selection function, such a printer determines whether the loaded paper size fits the designated size or not for each of a plurality of paper feed means in a fixed sequence to search the paper feed means in which the paper of the designated size are loaded. Thus, the user cannot change the sequence of determination in accordance with his desire or need.

Further, when the paper are not set in the designated paper feed means, the user cannot recognize the absence of paper at a timing of his desire or need.

SUMMARY OF THE INVENTION

It is an object of the present invention to provide a printer apparatus which permits a variable search priority in the automatic paper feed selection and the setting of any one of the instant request mode for the lack of paper and the delayed request mode for the lack of paper to permit an operator the setting with a higher degree of freedom.

In order to solve the above problems, the printer apparatus of the present invention comprises means for accepting the designation of search priority in the automatic paper feed and means for storing the accepted priority to allow the operator to freely designate the search sequence of the automatic paper feed.

Further, it comprises means for accepting the designation of the instant request mode for the lack of paper and the delayed request mode for the lack of paper and means for storing the accepted designation for each paper feed means to permit the operator to freely designate the timing of the request for the lack of paper.

Other objects,advantages and features of the present invention will be apparent from the following detailed description and the accompanying drawings.

BRIEF DESCRIPTION OF THE DRAWINGS

FIGS. 9A to 9C show maps in a RAM 307 in an embodiment 2.

DETAILED DESCRIPTION OF THE PREFERRED EMBODIMENTS

Embodiment 1

Figure 1:
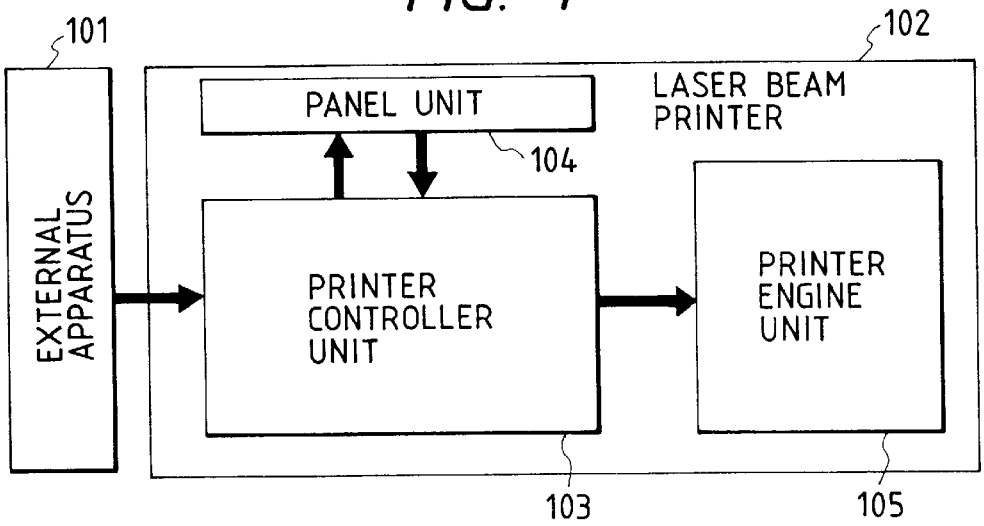
FIG. 1 shows a block diagram of an overall configuration of a system including a printer to which the present invention is applied.

FIG. 1 shows a system configuration including a printer in an embodiment 1. In FIG. 1, numeral 101 denotes an external equipment or external apparatus such as a host computer and numeral 102 denotes a laser beam printer to which the present invention is applied. Numeral 105 denotes a printer engine unit for forming a latent image on a photo-conductor drum by a known electrographic process in accordance with image data (binary or multi-value data), numeral 103 a printer controller unit connected to the printer engine unit 105 for receiving code data (ESC code or various PDL) sent from the external equipment 101 such as the host computer, generating page information comprising dot data in accordance with the code data and transmitting the image data to the printer engine unit 105 through interface means, and numeral 104 denotes a panel unit for interfacing with a user (operator). The user may designates a desired operation mode to the printer 102 by manipulating the panel unit 104.

Figure 2:
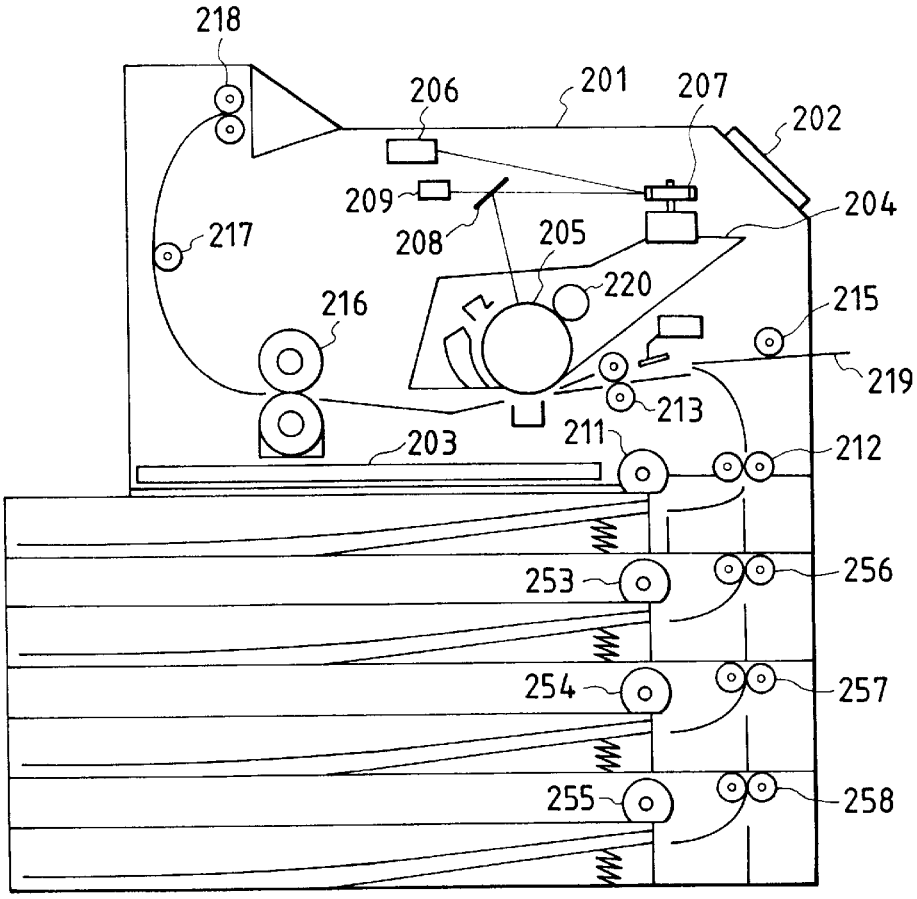
FIG. 2 shows a mechanism for paper feed of the printer to which the present invention is applied.

FIG. 2 shows a mechanism of the printer of the embodiment 1. In FIG. 2 numeral 201 denotes a printer housing and numeral 202 denotes a console panel on which operation switches, LED displays and LCD displays are arranged. The operation panel 202 is a physical side of the panel unit 104 shown in FIG. 1. Numeral 203 denotes a control board housing which houses the printer engine unit 105 for controlling the print process of the printer and the printer control unit 103 for controlling the overall printer and analyzing the data from the host computer to convert it to the image data.

Numeral 210 denotes a paper cassette for holding paper and has a mechanism for electrically sensing a paper size by a partition plate, not shown. Numeral 211 denotes a cassette paper feed clutch which is rotated intermittently for each feed by a cam which separates only the topmost one of the paper stacked on the paper cassette 210 and feeds the separated paper to a paper feed roller 212 so that one paper is fed for one revolution. Numeral 214 denotes a registration shutter which presses the paper to stop the paper. The paper feed roller 212 feeds a leading edge of the paper to the regist shutter 214.

Numeral 250 denotes a paper cassette for holding the paper. It has a mechanism for electrically detecting the paper size by a partition plate, not shown. Numeral 253 denotes a cassette paper feed clutch which is rotated intermittently for each feed by a cam which separates only the topmost one of the paper stacked on the paper cassette 250 and feeds the separated paper to a paper feed roller 256 so that one paper is fed for one revolution. The paper feed roller 256 feeds the paper to the paper feed roller 212.

Numeral 251 denotes a cassette for holding paper. It has a mechanism for electrically detecting the paper size by a partition plate, not shown. Numeral 254 denotes a cassette paper feed clutch which is rotated intermittently for each feed by a cam which separates only the topmost one of the paper stacked on the paper cassette 251 and feeds the separated paper to a paper feed roller 257 so that one paper is fed for one revolution. The paper feed roller 257 feeds the paper to the paper feed roller 256.

Numeral 252 denotes a cassette for holding paper. It has a mechanism for electrically detecting the paper size by a partition plate, not shown. Numeral 255 denotes a cassette paper feed clutch which is rotated intermittently for each feed by a cam which separates only the topmost one of the paper stacked on the paper cassette 252 and feeds the separated paper to a paper feed roller 258 so that one paper is fed for one revolution. The paper feed roller 258 feeds the paper to the paper feed roller 257.

Numeral 219 denotes a manual paper feed tray and numeral 215 denotes a manual paper feed clutch. The paper feed clutch 215 feeds a leading edge of the paper to the registration shutter 214.

With such an arrangement, the paper may be selectively fed from the paper feed cassettes 210–252 and the manual paper feed tray 219.

The printer engine unit 105 communicates with the printer controller unit 103 by a predetermined communication protocol, selects one of the cassettes 210, 250, 251 and 252 and the manual paper feed tray 219 in response to a command from the printer controller unit 103 and starts the feed in response to a command to start the printing to feed the paper to the registration shutter 214.

Numeral 204 denotes a cartridge which has a photo-conductor drum 205 and a toner holder, not shown, Numeral 206 denotes a laser driver, numeral 207 denotes a rotating polygon mirror, numeral 208 denotes a reflection mirror and numeral 209 denotes a beam detector. When the paper is fed to the registration shutter, a laser beam which is emitted from a semiconductor laser, not shown, which is driven on and off by a laser driver in accordance with image data sent from the printer controller 103 is scanned in a main scan direction by the rotating polygon mirror 207 and directed to the photo-conductor drum 205 through the reflection mirror and focused thereon, and scans it in the main scan direction to form a latent image on the main scan line.

In synchronism with the emission of the laser beam, the registration shutter 214 is move upward to synchronize the feed of the paper to a sub-scan of the laser beam. The beam detector 209 arranged at the start of the scan of the laser beam detects the laser beam to from a synchronization signal to determine a write timing of the image of the main scan and sends it to the printer controller unit 103.

Then, the paper is fed by the feed roller 213 and the photo-conductor drum is driven by a motor (not shown) and the image thereon is expanded by an expanding unit 220 as a toner image and it is transferred to the paper. The paper having the toner image transferred thereto is heated by a fixing roller 216 to fix the toner image and it is ejected to an eject tray of the printer housing by an eject roller 218 through the paper feed roller 217.

Figure 3:
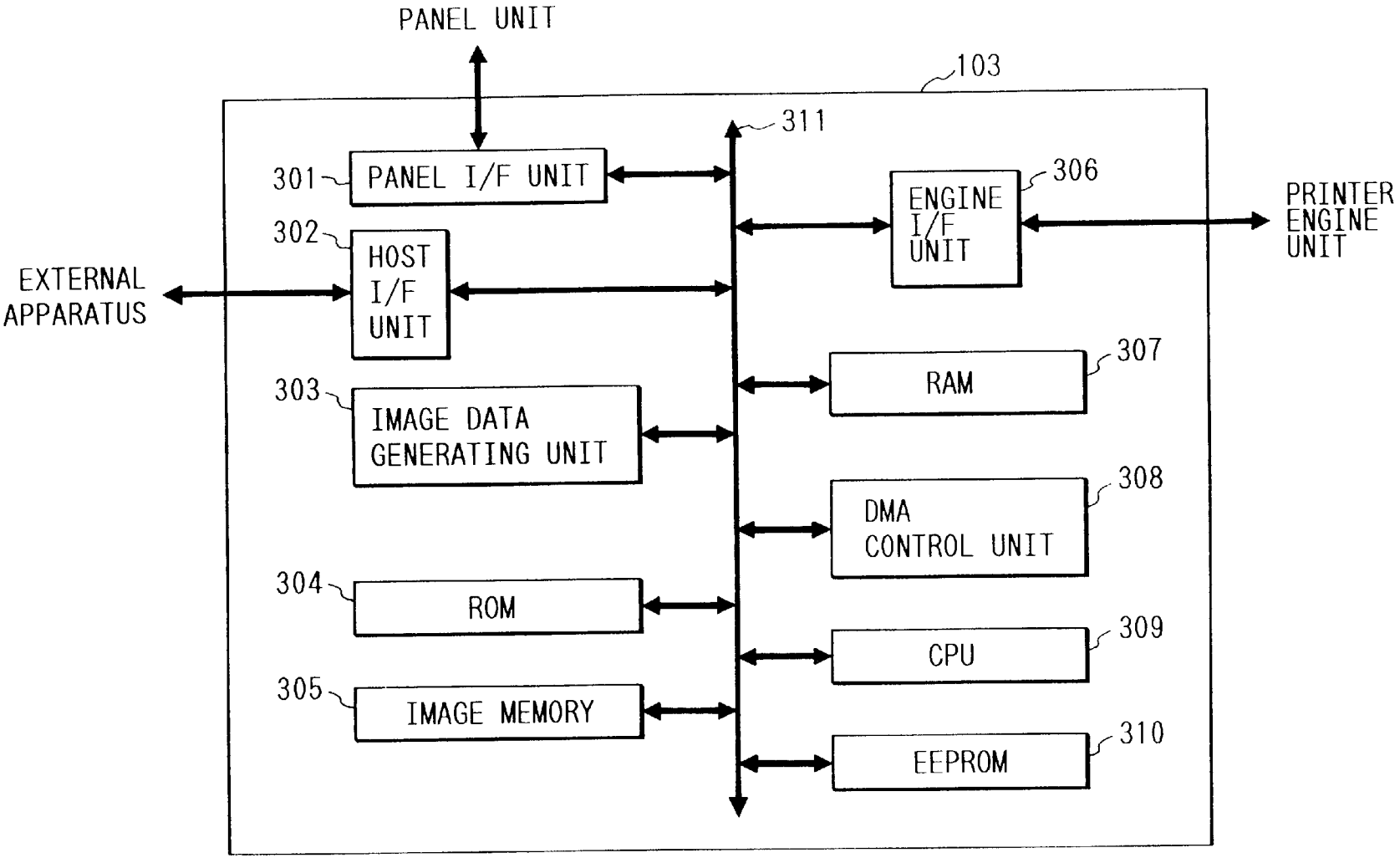
FIG. 3 shows a block diagram of an electric configuration of a printer controller to which the present invention is applied.

FIG. 3 shows a block diagram of the printer controller unit 103 of the present embodiment. In FIG. 3, numeral 301 denotes a panel interface unit for receiving settings and instructions by the operator through the panel unit 104 through data communication with the panel unit 104, numeral 302 denotes a host interface unit which is an input/output unit of signals for the external equipment such as the host computer and numeral 306 denotes an engine interface unit which is an input/output unit of signals for the printer engine unit 105. It sends the data signal from an output buffer register, not shown, and controls the communication with the printer engine 105.

Numeral 303 denotes an image data generation unit for generating bit map data for actual printing in accordance with the control code data sent from the external equipment 101, numeral 305 denotes an image memory for storing the image data, numeral 309 denotes a CPU for controlling the overall printer controller unit 103, numeral 304 denotes a ROM for storing the control code of the CPU 309 and numeral 307 denotes a temporary storing RAM used by the CPU. Numeral 310 denotes an EEPROM which is non-volatile memory means. Numeral 308 denotes a DMA control unit which transfers the bit map data in the image memory to the engine interface unit 306 by a command from the CPU 309.

Numeral 311 denotes a system bus having an address bus and a data bus, and the panel interface unit 301, the host interface unit 302, the image generation unit 303, the ROM 304, the image memory 305, the engine interface unit 306, the RAM 307, the DMA control unit 308, the CPU 309 and the EEPROM 310 are connected to the system bus 311. The CPU 309 may access to all function units on the system bus 311.

The control code for controlling the CPU 309 comprises an OS for effecting time-division control for each load module called a task by a system clock (not shown) and a plurality of load modules (tasks) which are operated for each function unit.

Figure 4:
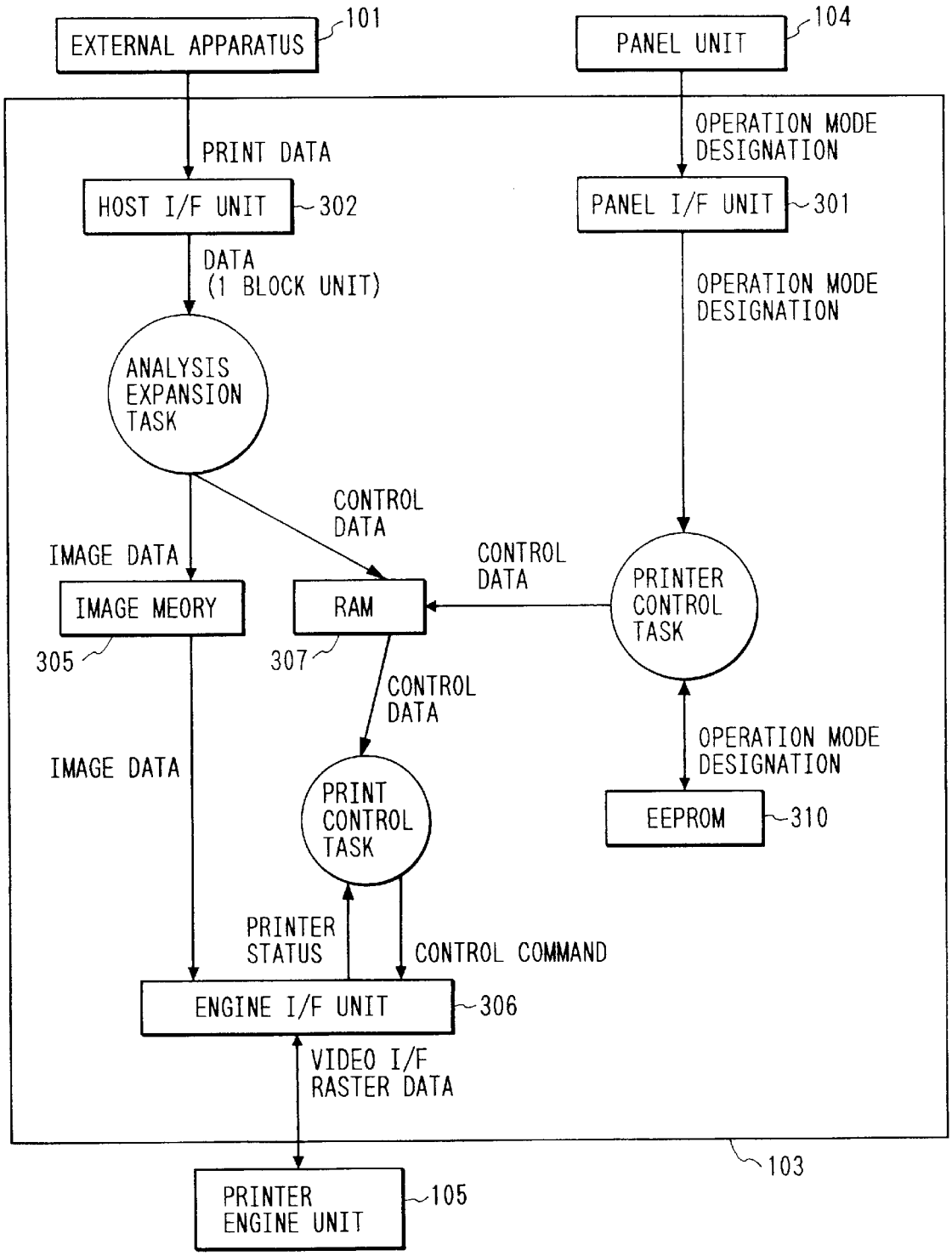
FIG. 4 shows a data flow in an embodiment 1.

FIG. 4 shows a data flow of the embodiment 1. An analysis expansion task, a printer control task and a print control task are ones based on the CPU 309 and operated logically parallelly.

The print data (control code, PDL, etc.) inputted from the external equipment 101 is stored in the host interface unit 302 for each block. The analysis expansion task analyzes the data for each block and expands the image forming information (PDL graphic draw command, character code, etc.) by using the image data generation unit 303 (FIG. 3 and not shown in FIG. 4) or by the CPU 309 itself, and stores it in the corresponding area in the image memory 305. The control information for the printer (the number of copies, the selection of paper feed, etc.) is stored in a predetermined control information storage area of the RAM 307.

On the other hand, the operation mode designation (the number of copies, the paper feed selection, etc.) from the panel unit 104 is temporarily stored in the panel interface unit 301. The printer control task periodically monitors the panel interface unit 301 at an appropriate interval, and if data is present, it is stored in the EEPROM 310 and also stored in the control information storage area of the RAM 307. By storing it in the EEPROM 310, the printer may be operated upon request by the user even after the power off of the printer power supply.

Figures 5A, 5B:
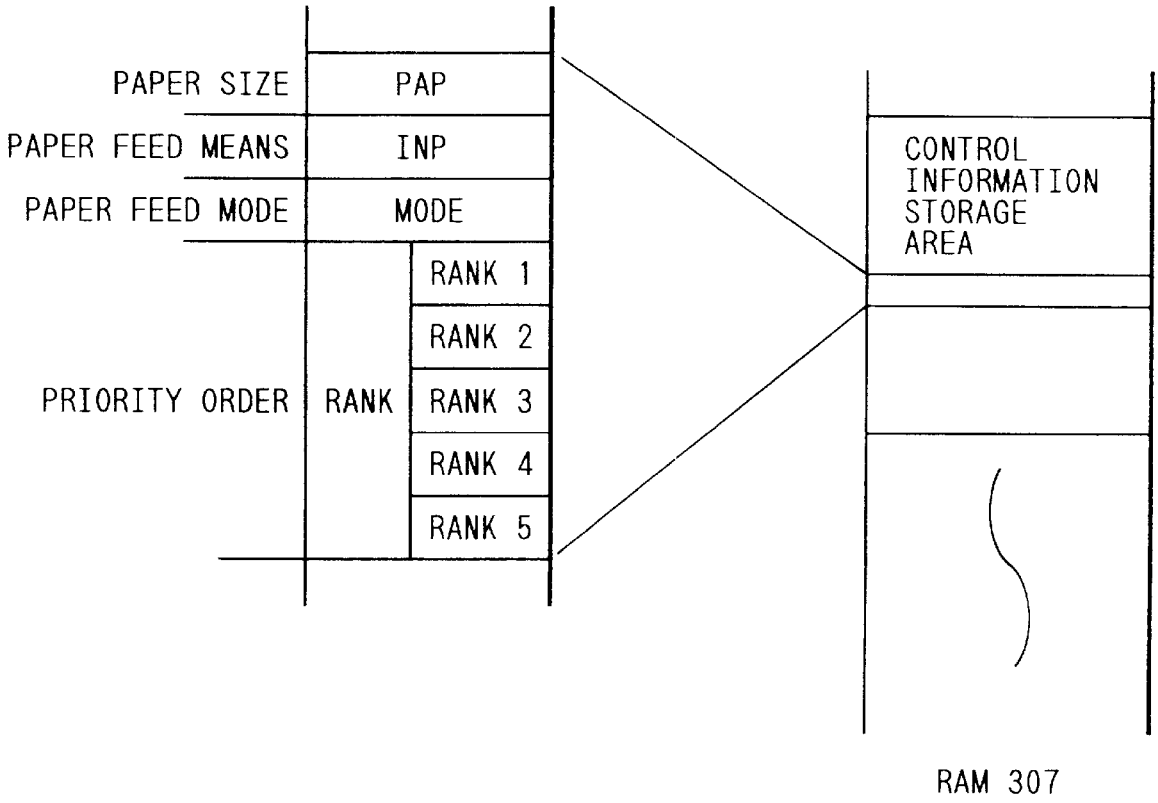
FIG. 5A shows a map of a RAM 307 in the embodiment 1.
FIG. 5B shows a table of values of INP/MODE/RANKn and the significance thereof in the embodiment 1.

FIG. 5A shows a portion of the control information storage area of the RAM 307 and shows the information table of the embodiment 1. The "paper size" designates the paper size to be used for printing and a value PAP for logically processing the paper size by the control code is stored. For example, when PAP is 1, it indicates a size A3 paper, when it is 2, it indicates a size A4 paper. When it is 3, it indicates a size B4 paper, and when it is 4, it indicates a size B5 paper.

The "paper feed means" designates the paper feed means to be actually indicated to the printer engine unit 105 and a value INP for logically processing the paper feed means by the control code is stored. For example, when the INP is 1, it indicates the paper feed cassette 210, when it is 2, it indicates the paper feed cassette 250, when it is 3, it indicates the paper feed cassette 251, when it is 4, it indicates the paper feed cassette 252, and when it is 5, it indicates the manual tray 219.

The "paper feed mode" includes a "fixed paper feed mode" in which the paper feed means is directly designated and an "automatic paper feed mode" in which the paper feed means in which the paper of the size designated by the "paper size" is loaded is automatically searched. For the "fixed paper feed mode", the same value as that stored in the INP ("1"–"5") is stored, and for the "automatic paper feed mode", "6" is stored. The "priority" indicates a priority for the automatic search when the "paper feed mode" is the "automatic paper feed mode". It has storage areas RANK1–RANK5 in the order of the priority and one of the values "1"–"5" is stored in each of them.

In FIG. 4 the print control task is started by a command from the analysis expansion task and issues a command of paper feed selection to the printer engine 105 through the engine interface unit 306 in accordance with the control information in the RAM 307. It also issues a command to the DMA controller unit 308 (FIG. 3) to transfer the image data of the image memory 305 to the output buffer register, not shown, and commands to the engine interface unit 306 to start the transmission of the image data. The engine interface unit 306 transfers the image data to the printer engine unit 105 by a predetermined protocol and the printer engine unit 105 prints it.

Figure 6:
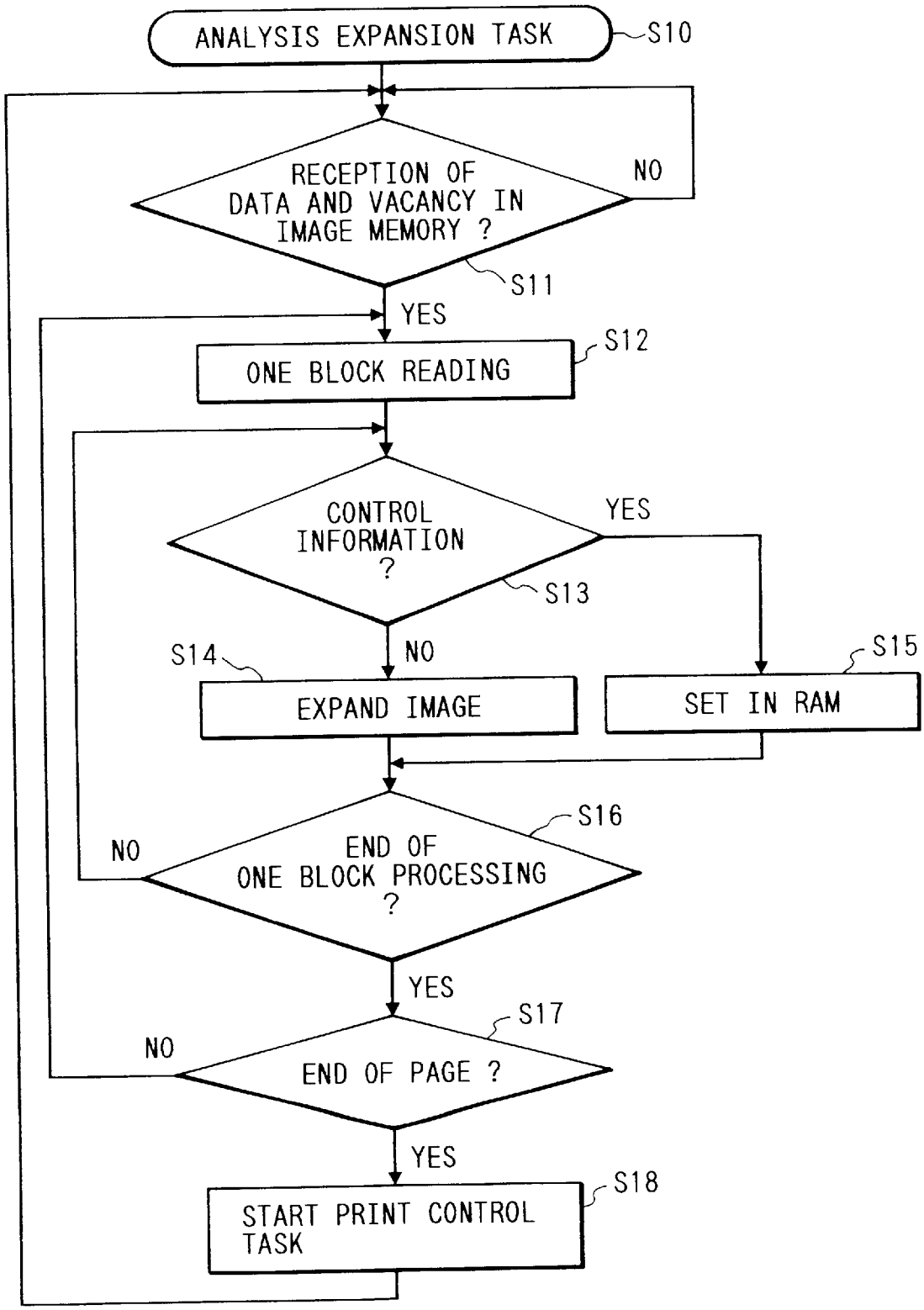
FIG. 6 shows a control flow chart for illustrating an operation of a CPU 309 in the embodiment 1.

FIG. 6 shows a control flow chart of the analysis expansion task. When the analysis expansion task is started upon power-on (S10), the presence or absence of the data reception is inquired to the host interface unit 302 at an appropriate interval and the vacant area state is inquired to the image memory 305 (S11). If the data is present and the area is vacant, a predetermined block of data is written in a working area for the CPU 309 in the RAM 307 from the host interface unit 302 (S12). The control codes and data in the block are sequentially determined (S13), and for the control information, predetermined data conversion is performed and it is stored in the control information storage area in the RAM 307 (S15). The image information relies on the image data generation unit 303 or the image is expanded by the CPU 309 and stored in a predetermined area in the image memory 305 (S14). The above operation is repeated until the completion of the analysis process of one block (S16). The process is continued for each block until a page end code is detected (S17). At the page end, the print control task is started by relying on the OS (S18).

Figure 7:
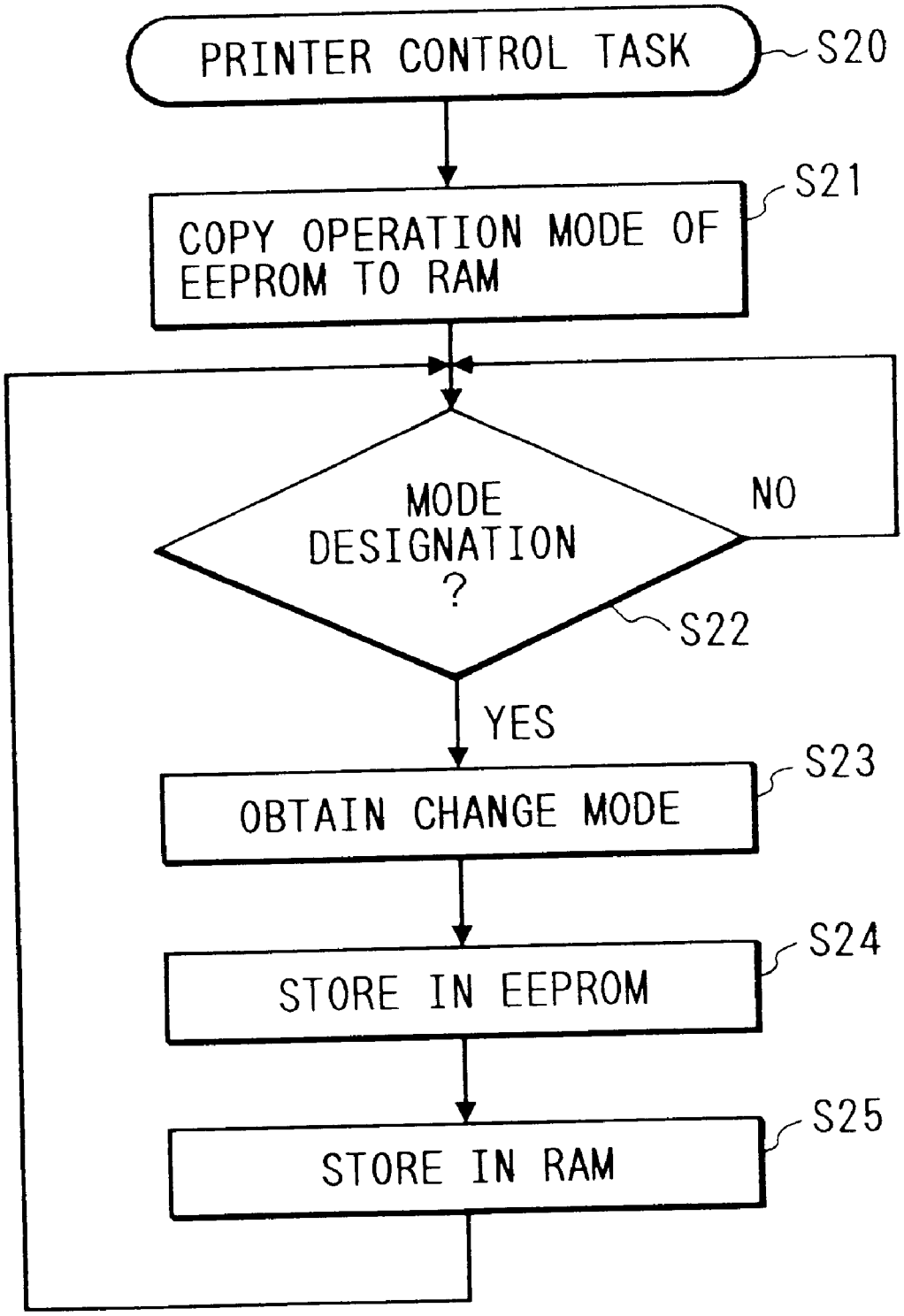
FIG. 7 shows a control flow chart for illustrating an operation of the CPU 309 in the embodiment 1.

FIG. 7 shows a control flow chart of the printer control task. When the printer control task is started upon power-on (S20), it copies all operation modes including the "paper feed means" from the EEPROM 310 into the RAM 307 as the control data (S21). Whether the mode designation has been received from the user to the panel interface unit 301 is checked at an appropriate interval (S22). If the operation mode designation has occurred, the changed operation mode is obtained from the panel interface unit 301 (S23) and it is stored in the EEPROM 310 (S24). A predetermined conversion is performed and the result is stored in the RAM 307 as the control data (S25). The operation mode designation includes the paper feed means designation (for the fixed paper feed mode) and the automatic paper feed mode designation as well as the priority designation for each paper feed means. The designation of such operation modes may be conducted by command data from the external equipment 101.

Figures 8A, 8B:
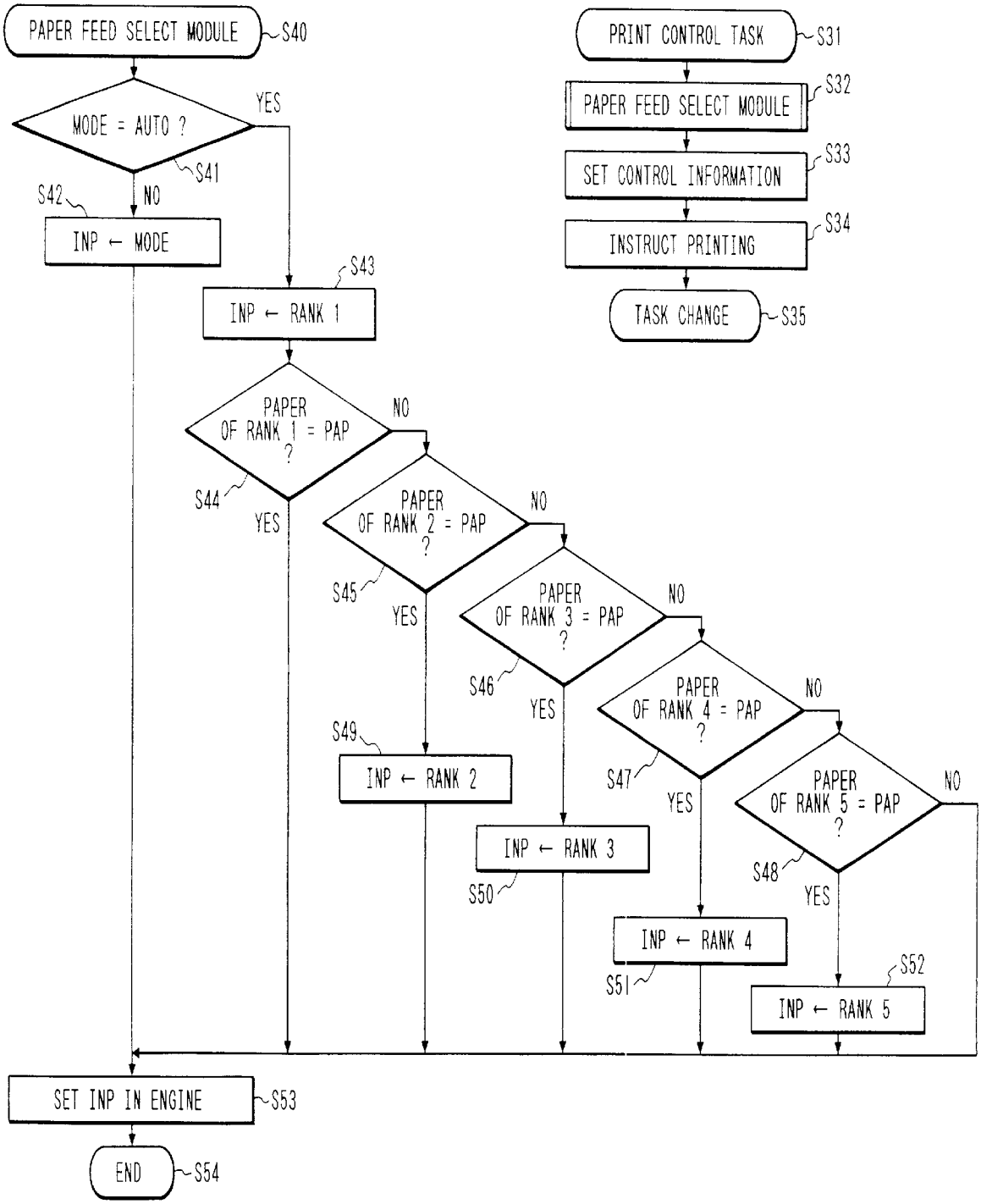
FIGS. 8A and 8B show control flow charts for illustrating operations of the CPU 309 in the embodiment 1.

FIG. 8A shows a control flow chart of the print control task. When the print control task is started by the analysis expansion task (S31), it determines the paper feed means and informs it to the printer engine 105 (S32) and informs other control information to the printer engine unit 105 through the engine interface unit 306 (S33) and commands to start the printing by a predetermined protocol through the engine interface unit 306 (S34) and then terminates (S35).

Detail of the step S32 is explained from S40 in FIG. 8B. When the "paper feed mode" (MODE) shown in FIG. 5A is not the "automatic paper feed mode" ("6"), the value of the "paper feed mode" (MODE) is set as it is in the "paper feed means" (INP) (S42) and the process proceeds to S53.

On the other hand, when the "paper feed mode" (MODE) is the "automatic paper feed mode" ("6") (S41), the paper feed means which is set in the RANK1 is set in the "paper feed means" (IND) (S43) and the paper sizes of the paper feed means of the RANK1 and the presence or absence of the paper therein are inquired to the printer engine unit 105 (S44). When the paper is present and the size is same as the "paper size" (PAP) in the RAM 307, the process proceeds to S53. Otherwise, the process proceeds to S45.

In S45, the paper size of the paper feed means of the RANK2 and the presence or absence of the paper therein are inquired to the printer engine unit 105. When the paper is present and the size is the same as the "paper size" (PAP) in the RAM 307, the paper feed means which is set in the RANK2 is set in the "paper feed means" (S49) and the process proceeds to S53. Otherwise, the process proceeds to S46.

In S46, the paper size of the paper feed means of the RANK3 and the presence or absence of the paper therein are inquired to the printer engine unit 105. When the paper is present and the size is same as the "paper size" (PAP) in the RAM 307, the paper feed means which is set in the RANK3 is set in the "paper feed means" (S50) and the process proceeds to S53. Otherwise, the process proceeds to S47.

In S47, the paper size of the paper feed means of the RANK4 and the presence or absence of the paper therein are inquired to the printer engine unit 105. When the paper is present and the size is same as the "paper size" (PAP) in the RAM 307, the paper feed means which is set in the RANK4 is set in the "paper feed means" (S51) and the process proceeds to S53. Otherwise, the process proceeds to S48.

In S48, the paper size of the paper feed means of the RANK5 and the presence or absence of the paper therein are inquired to the printer engine unit 105. When the paper is present and the size is same as the "paper size" (PAP) in the RAM 307, the paper feed means which is set in the RANK5 is set in the "paper feed means" (S52) and the process proceeds to S53. Otherwise, the process does nothing and proceeds to S53. If the decision in S48 is NO, a paper size out error may be displayed to stop the apparatus.

In S53, the paper feed means which is set in the "paper feed means" (INP) is indicated to the printer engine unit 105. Then, the process terminates (S54).

A specific example of the automatic paper feed mode is shown. For example, when the size A4 paper are loaded in the paper cassette 250, the size B4 paper are loaded in the paper cassette 251, the size B5 paper are loaded in the paper cassette 252, no paper is loaded in the manual insertion tray 219, and the "priority" is such that the RANK1 is "5" (the manual insertion tray 219), the RANK2 is "1" (the paper cassette 210), the RANK3 is "2" (the paper cassette 250), the RANK4 is "3" (the paper cassette 251) and the RANK5 is "4" (the paper cassette 252), and when the paper size B4 is designated from the external equipment 101, the paper size is compared in the descending order of the RANK and the size B4 is detected in the RANK4 and the paper cassette 251 (INP=3) is finally set as the paper feed means designated to the printer engine unit 105.

By the above configuration and control, the search in the automatic paper feed mode is performed in the priority determined by the user.

While the present embodiment is applied to the laser beam printer which is preferable to the present invention, the present invention may also be applicable to any printer apparatus having a plurality of paper feed means such as an ink jet printer, a facsimile apparatus, a copying apparatus or a combination thereof.

Embodiment 2

A configuration of the embodiment 2 is identical to that of the embodiment 1 and the like functional units are designated by the like numerals and the like steps are designated by the like step numbers. Accordingly, the explanation thereof is omitted.

FIGS. 9A and 9B show a portion of the control information storage area of the RAM 307 and show an information table of the embodiment 2. In FIGS. 9A and 9B, the "paper size" (PAP), the "paper feed means" (INP) and the "paper feed mode" (MODE) are identical to those of the embodiment 1. The "priority" (RANK) designates the priority of the automatic search when the "paper feed mode" is the "automatic paper feed mode". The storage areas are assigned with the RANK1–RANK5 in the descending order of the priority and each has the value "1"–"5" described in the embodiment 1 as well as "11" indicating a "group 1", "12" indicating a "group 2" or "13" indicating a "group 3" stored therein (FIG. 9C). Further, in order to determine a priority in each group, a storage area shown in FIG. 9B is allocated. In this area, the values "1"–"5" described above as well as "0" indicating "no paper feed means designated" are stored.

The table is constructed as shown in FIG. 9B and set in the RAM 307 by the analysis expansion task or the printer control task in the same manner as that described in the embodiment 1 so that the paper feed means are grouped and prioritized for each group. The priority within the group may also be applied.

Figure 10A:
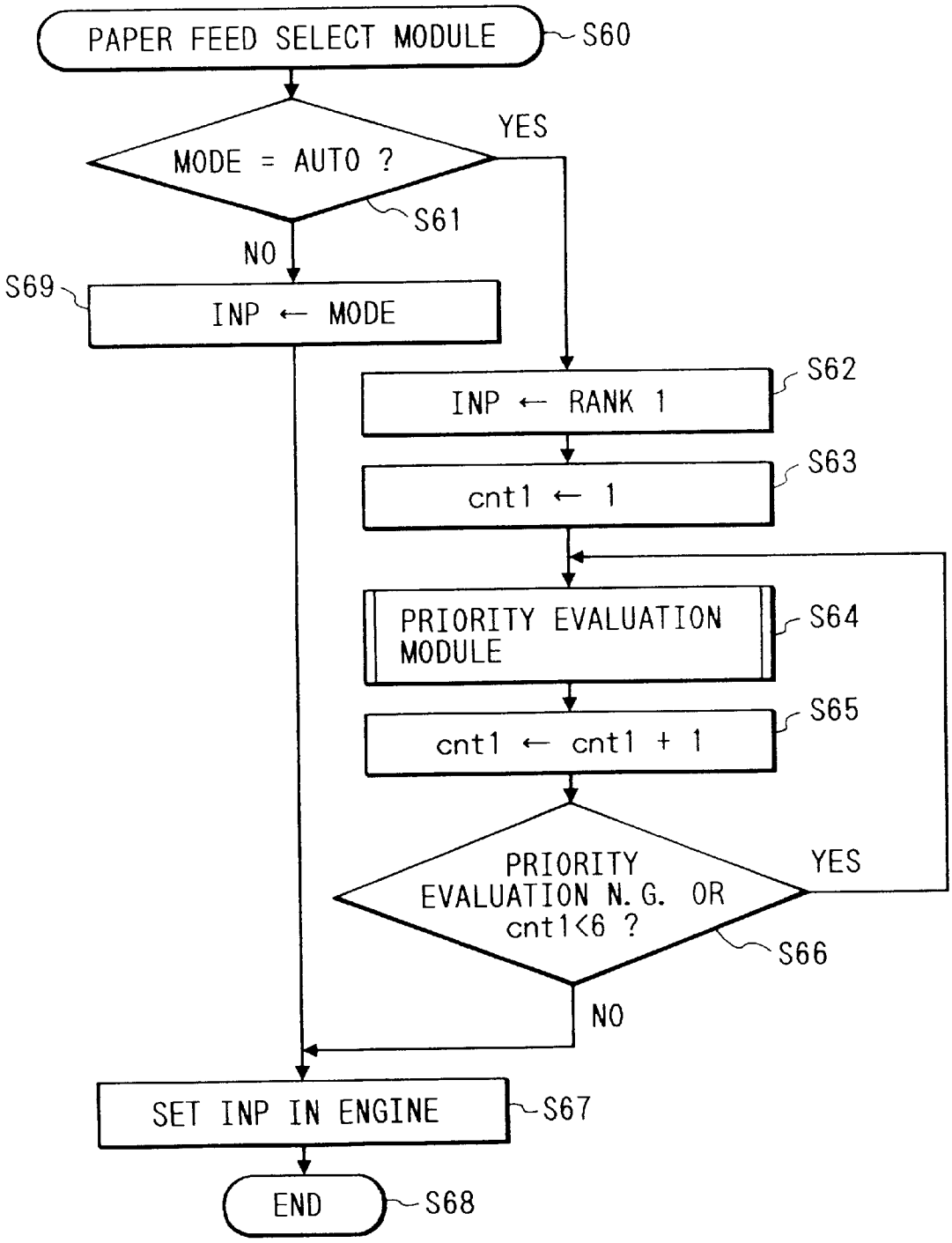
FIGS. 10A to 10C show control flow charts for illustrating operations of the CPU 309 in the embodiment 2.

FIG. 10A shows a flow chart of a paper feed selection module showing a feature of the embodiment 2. A control flow chart of the print control task in the embodiment 2 is a combination of the flow chart shown in FIG. 8A and the paper feed selection module shown in FIG. 10A.

Detail of S32 in the embodiment 2 is explained from S60. When the "paper feed mode" (MODE) shown in FIG. 9A is the "automatic paper feed" ("6") (S61), the paper feed means which is set in the RANK1 is set in the "paper feed selection" (S62), and a counter area cnt1 (not shown) in the RAM 307 is set to 1 and the above steps are repeated by the number of "priority" tables ("5" in the present embodiment) until the evaluation of the priority evaluation module becomes "true" (S63, S64, S65 and S66). On the other hand, if the "paper feed mode" (MODE) is not the "automatic paper feed" ("6") (S61), the paper feed means which is set in the "paper feed mode" (MODE) is set as it is in the "paper feed means" (INP) (S69).

Figure 10B:
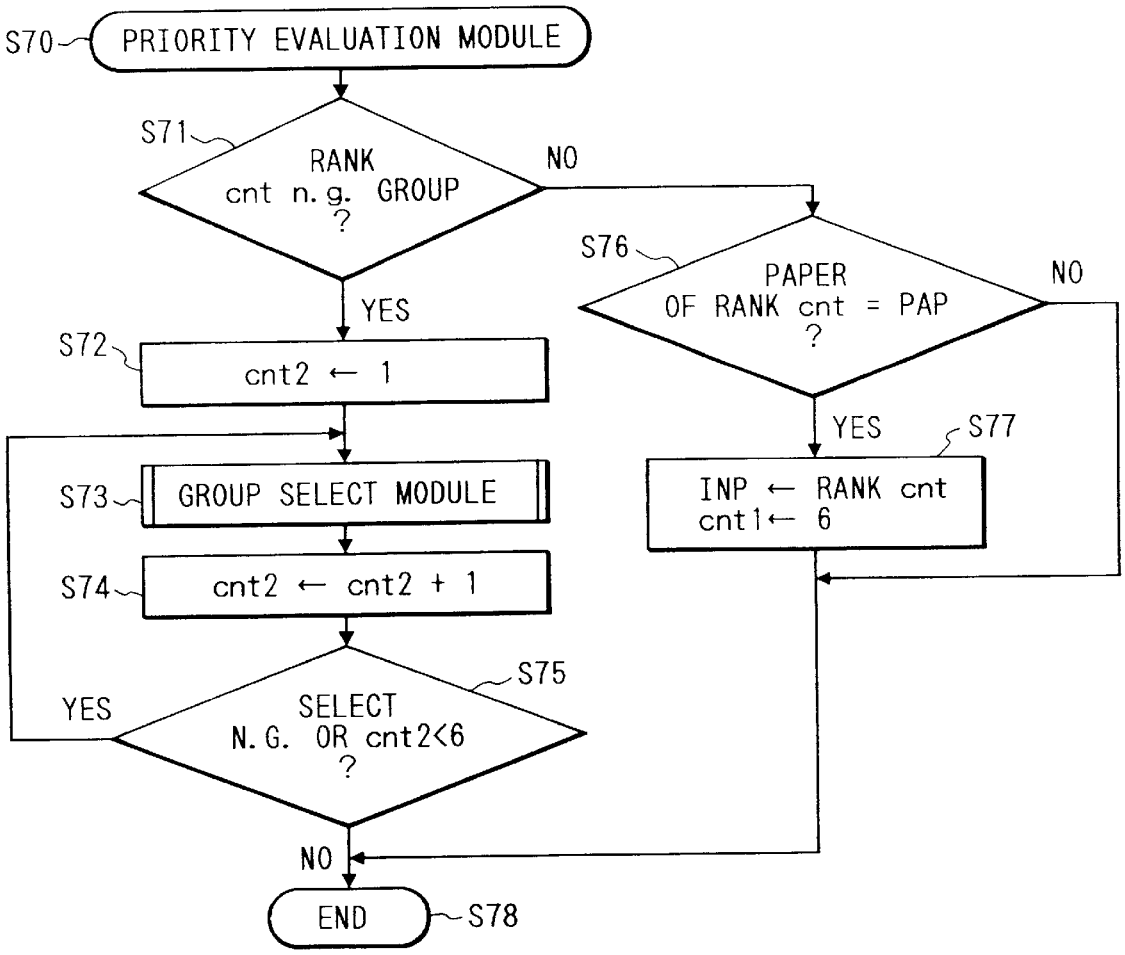

Detail of the priority evaluation module of S64 is explained with reference to FIG. 10B. When the value RANKcnt1 of the "priority" is not the ng group (values "11"–"13" (S71), the paper size of the paper feed means of the RANKcnt1 and the presence or absence of the paper therein are inquired to the printer engine unit 105. When the paper is present and the size is same as the "paper size" (PAP) in the RAM 307, the paper feed means which is set in the RANKcnt1 is set in the "paper feed means" (INP) to set the value cnt1 to "6" and the process terminates (S78). On the other hand, when the value RANKcnt1 of the "priority" is the ng group (S71), a counter area cnt2 (not shown) in the RAM 307 is set to 1 and the above steps are repeated by the number of tables of the group until the result of the group selection module becomes "true" (S72, S73, S74 and S75) and the process terminates (S78).

Figures 10C, 12:
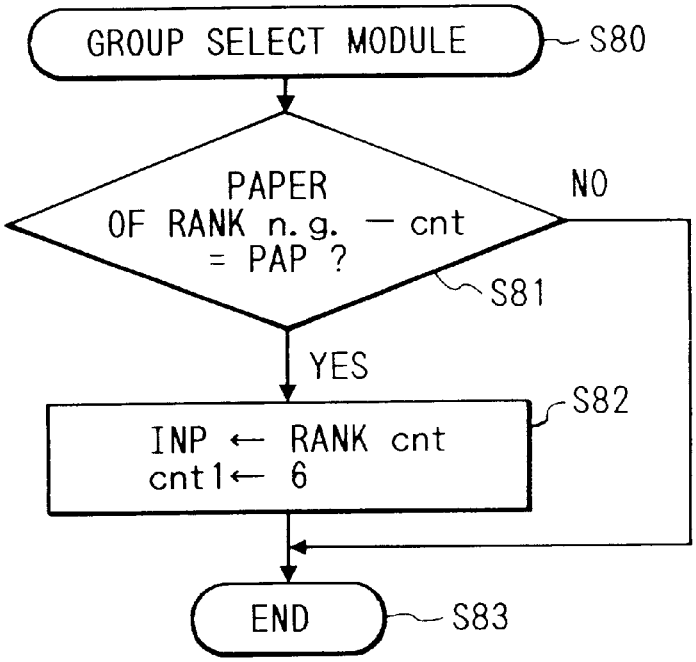
FIG. 12 shows a map of the RAM 307 in the embodiment 3.

Detail of the group selection module of S73 is explained from S80 with reference to FIG. 10C. The paper size of the paper feed means of the RANKcnt2 of the priority item of the ng group (RANK1-cnt2 if the value RANKcnt1 is "11", RANK2-cnt2 if the value is "12", and the RANK3-cnt2 if the value is "13" and the presence or absence of the paper therein are inquired to the printer engine unit 105 (S81). When the paper is present and the size is same as the "paper size" in the RAM 307, the paper feed means which is set in the RANKcnt2 is set in the "paper feed means" (INP) and the cnt1 is set to "6" (S82) and the process is terminated (S83). Otherwise, the process performs nothing and terminates (S83).

By the above configuration and control, the paper feed means may be grouped as the user desires and the priority among the groups and the priority in the group may be variably set to conduct the search in the automatic paper feed mode. The value cnt1 which is set in S77 and S82 may be set to "7" or larger and if cnt1=6 immediately before S67, the no paper error may be displayed to prompt to the operator to supply the paper.

In the present embodiment, the priority in the group may be set as desired by the manipulation of the panel or a command from the external equipment. Alternatively, the priority in the group may be fixed. The grouping of the paper feed means need not be set by the manipulation of the panel or a command from the external equipment. For example, the cassettes 210, 250, 251 and 252 may be a fixed group and the priority between the manual insertion tray 219 and the cassettes 210, 250, 251 and 252 may be set by the manipulation of the panel or a command from the external equipment.

While the embodiment 2 is applied to the laser beam printer which is preferable to the present invention, the present invention is also applicable to any image forming apparatus having a plurality of paper feed means such as an ink jet printer, a facsimile apparatus, a copying apparatus or a combination thereof.

Embodiment 3

A configuration of the embodiment 3 is identical to that shown in FIGS. 1–3 of the embodiment 1 and the like functional units are designated by the like reference numerals. Differences from the embodiment 1 are described below.

FIG. 12 shows a portion of a control information storage area of the RAM 307 and shows an information table of the embodiment 3. In FIG. 12, a PMODE1 designates whether the paper cassette 210 is to operate in the instant request mode for the lack of paper or the delayed request mode for the lack of paper. When it is "1", it designates the instant request mode for the lack of paper, and when it is "0", it designates the delayed request mode for the lack of paper. Similarly, a PMODE2 designates the paper cassette 250, a PMODE3 designates the paper cassette 251, a PMODE4 designates the paper cassette 252 and a PMODE5 designates the manual insertion tray 219. By constructing the table as shown in FIG. 12 and setting the RAM 307 by the analysis expansion task or the printer control task in the same manner as that in the embodiment 1, the operation mode for the lack of paper may be designated individually for the paper feed means.

Figure 11:
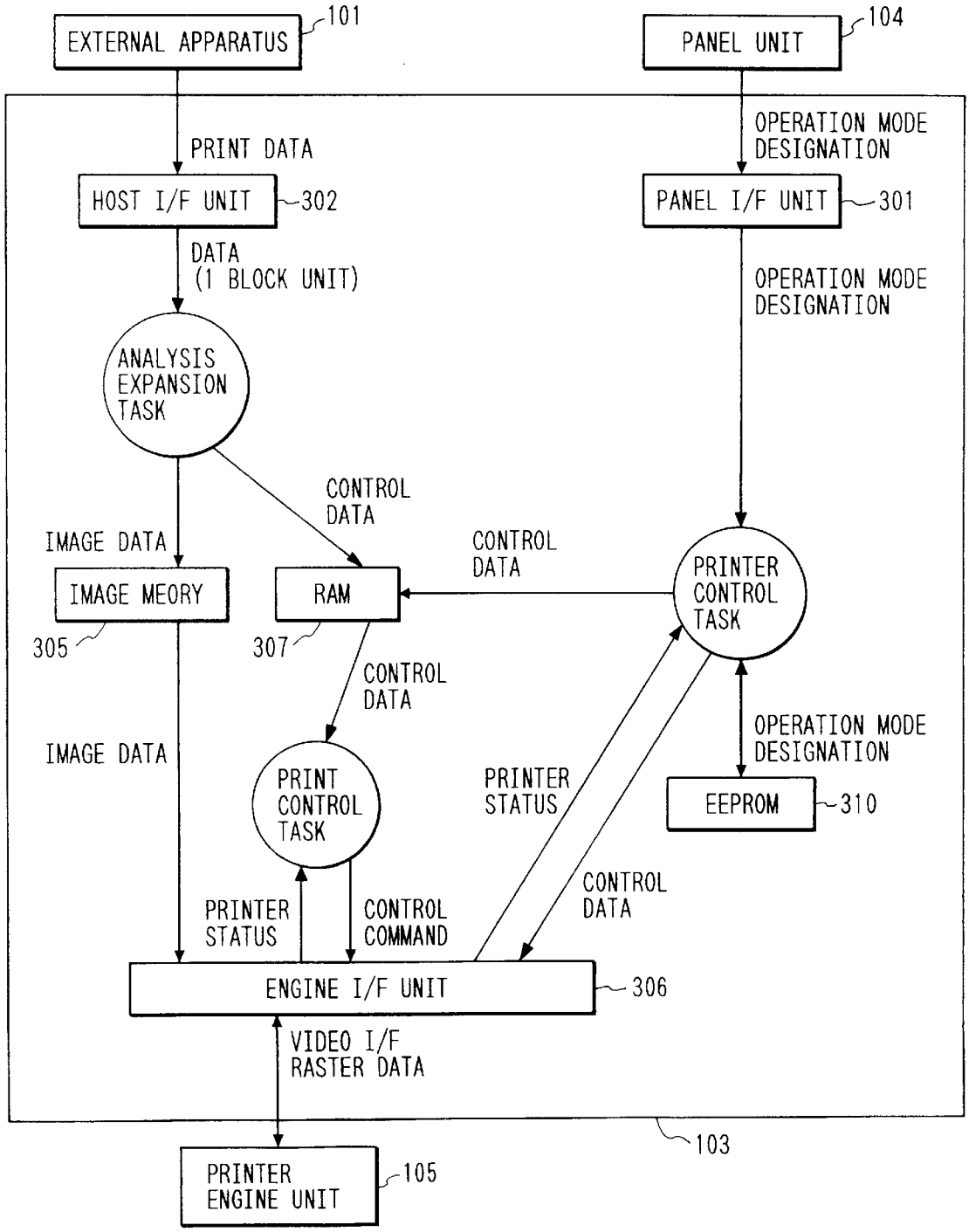
FIG. 11 shows a data flow in an embodiment 3.

FIG. 11 shows a data flow of the embodiment 3. When the mode change commands received by the panel interface unit 301 include a change of the paper feed selection, the printer control task immediately inquires the presence or absence of the paper to the printer engine unit 105 through the engine interface unit 306. If the designated paper feed means is now in the instant request mode for the lack of paper, it commands to the panel interface unit 301 to display the "no paper".

On the other hand, when the print control task informs the paper feed means to the printer engine unit 105 immediately before the printing, it also inquires the presence or absence of the paper in the corresponding paper feed means, and if the corresponding paper feed means is in the delayed request mode for the lack of paper, it commands to the panel interface unit 301 to display the "no paper" after the completion of the analysis of one page of data as will be explained later.

Figure 13:
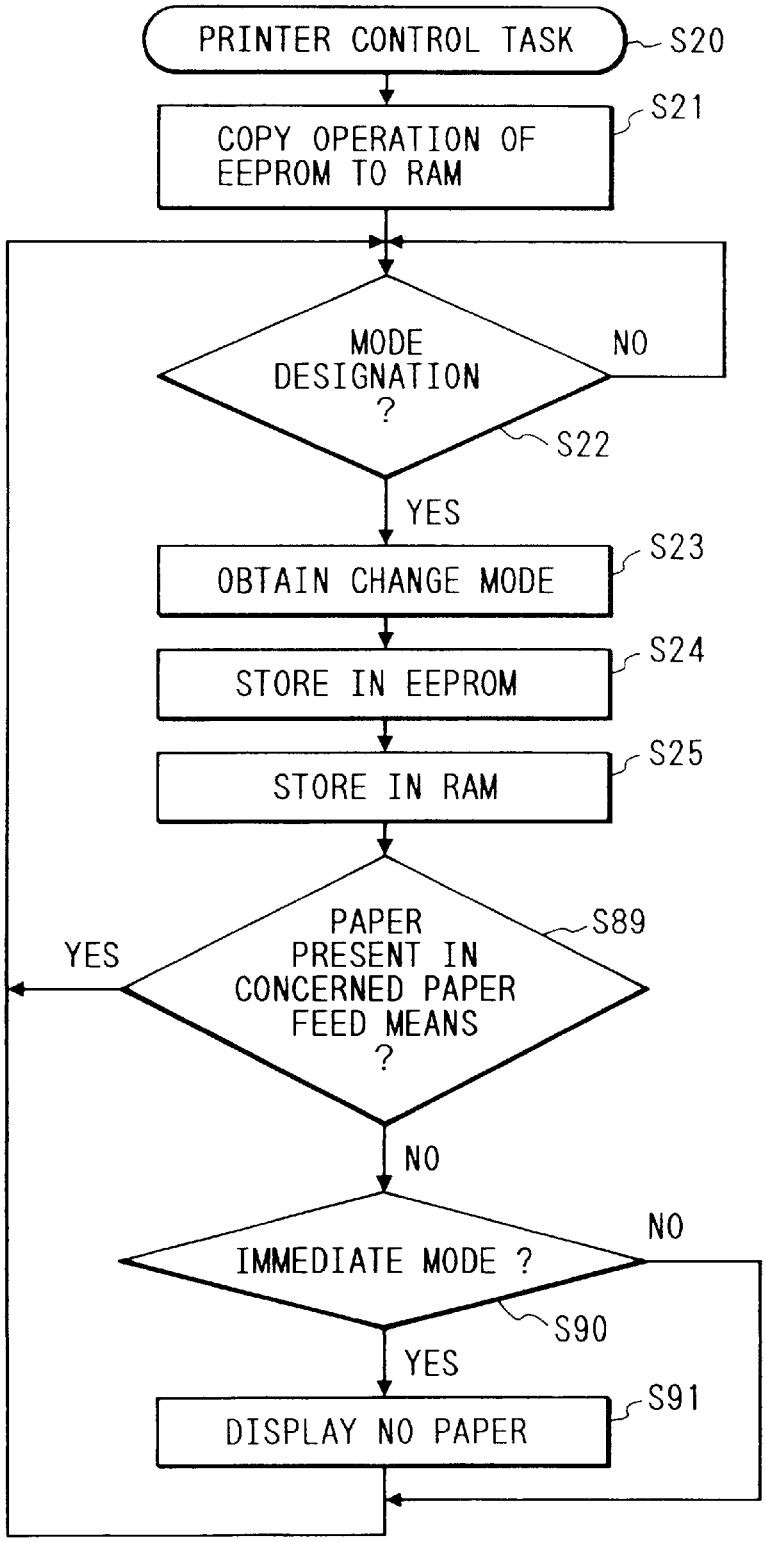
FIG. 13 shows a flow chart for illustrating an operation of the CPU 309 in the embodiment 3.

FIG. 13 shows a control flow chart of the printer control task showing a feature of the embodiment 3. In the control flow chart of the printer control task in the embodiment 3, S90 and S91 are added to the flow chart shown in FIG. 7. When the mode designation is the paper feed selection, the request operation mode for the lack of paper in the paper feed means is received from the control information storage area in the RAM 307 in addition to the operation explained for the embodiment 1, and if it is the instant request mode for the lack of paper, the presence or absence of the paper in the corresponding paper feed means is inquired to the printer engine unit, and if the lack of paper is detected (S89), the display of "no paper" is requested.

In S23 of FIG. 13, if it is the change to the automatic paper feed selection mode and the designated size has been set, the paper feed selection module described above may be executed after S25. If the designated size is not set, the paper feed selection module is executed after the designated size is set. However, S90 and S91 are executed if all paper feed means are lack of paper even if the designated size is not set.

Figure 14:
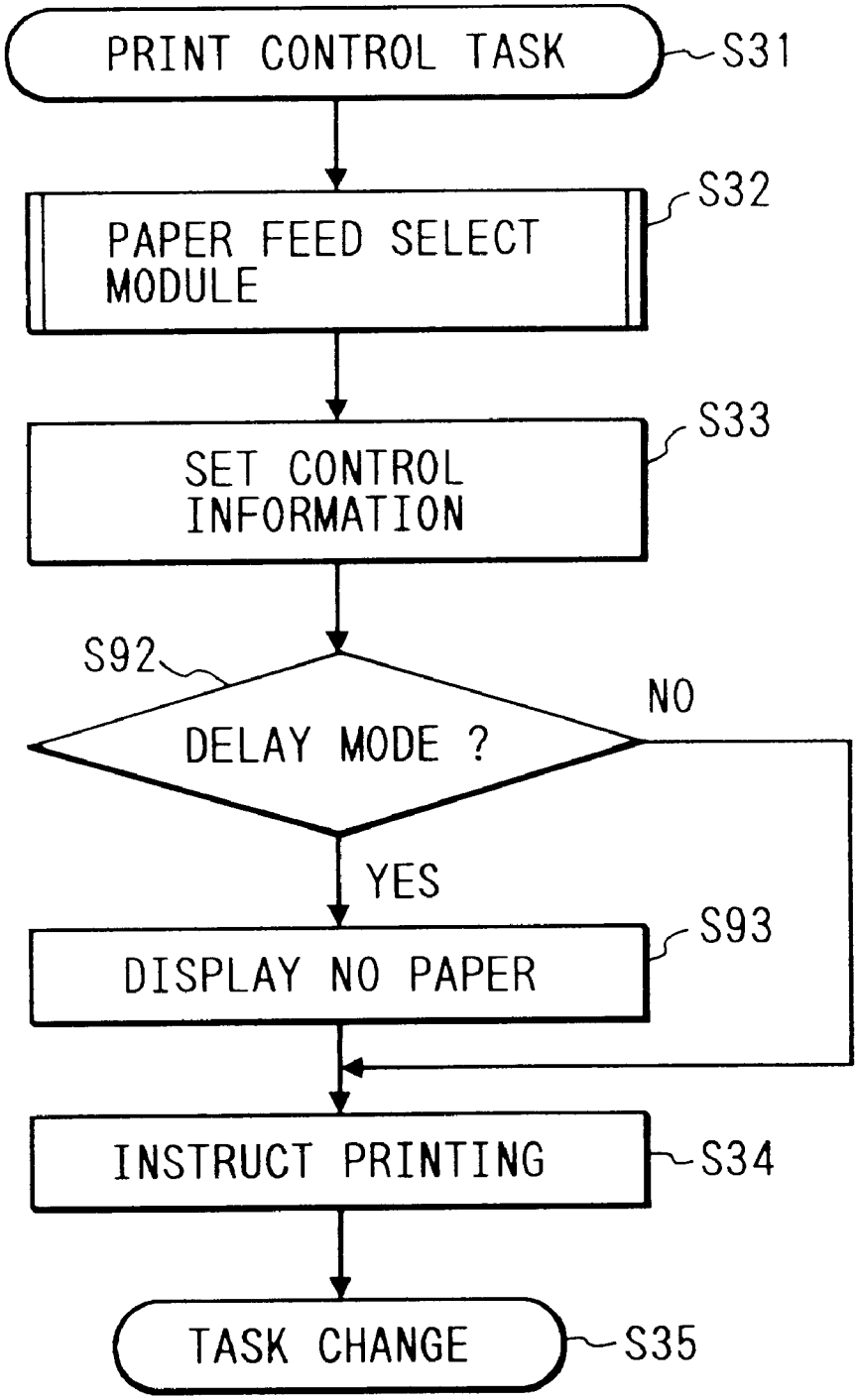
FIG. 14 shows a control flow chart for illustrating an operation of the CPU 309 in the embodiment 3.

FIG. 14 shows a control flow chart of the print control task indicating a feature of the embodiment 3. In the control flow chart of the print control task in the embodiment 3, S92 and S93 are added to the flow chart shown in FIG. 8A. When the print control is started and the control information is set and if the paper is absent in the corresponding paper feed means, the request operation mode for the lack of paper for the corresponding paper feed means is received from the control information storage area in the RAM 307, and if it is the delayed request mode for the lack of paper. The display of "no paper" is requested.

By the above configuration and control, the user may set the instant request mode for the lack of paper and the delayed request mode for the lack of paper may be set for each paper feed means.

While the embodiment 3 is applied to the laser beam printer which is preferable to the present invention, the present invention is also applicable to any image forming apparatus having a plurality of paper feed means such as an ink jet printer, a facsimile apparatus, a copying apparatus or a combination thereof.

In accordance with the present invention, since the means for accepting the designation of the search priority in the automatic paper feed and the means for storing the accepted priority are provided, the operator may designate a desired search sequence of the automatic paper feed.

Further, since the means for accepting the designation of the instant request mode for the lack of paper and the delayed request mode for the lack of paper and the means for storing the accepted designation for each paper feed means, the operator may designate a desired timing of the request for the lack of paper.

Thus, the user may designate the paper cassettes in which the paper of the same size are loaded as one group or automatic paper feed may be operated as desired depending on the load status such as the paper size and the paper color.

The embodiment 2 and the embodiment 3 may be combined.

It should be noted that the present invention is not limited to the above embodiments but they may be modified without departing from the scope of the claims.

What is claimed is:

1. A printer apparatus comprising:

at least one paper feed means for feeding paper;

detection means for detecting whether a paper is loaded in the paper feed means;

inform means for externally transmitting information of a lack of paper in response to detection by said detection means;

mode designation accepting means for accepting a designation of a first mode or a second mode;

mode storing means for storing the mode accepted by said mode designation accepting means;

control means responsive to said detection means and the stored mode wherein, when said first mode is designated, the external informing of the lack of paper is done immediately and, wherein, when the second mode is designated, the external informing of a lack of paper is delayed until a time necessary to start an actual paper feed from an alternate paper feed means; and printing means for printing on the fed paper.

2. A printer apparatus according to claim 1, wherein said inform means includes a display for displaying information on the lack of paper.

3. A printer apparatus according to claim 1, wherein said inform means includes means for informing external equipment of the lack of paper.

4. A printer apparatus according to claim 1, wherein said printer apparatus prints electrographically.

5. A printer apparatus according to claim 1, wherein a plurality of paper feed means are provided and a first, second and third mode can be set for each paper feed means.

6. A printer controlling apparatus comprising:

at least one paper feed means for feeding paper;

detection means for detecting whether a paper is loaded in the paper feed means;

inform means for externally transmitting information of a lack of paper in response to detection by said detection means;

mode designation accepting means for accepting a designation of a first mode or a second mode;

mode storing means for storing the mode accepted by said mode designation accepting means; and control means responsive to said detection means and the stored mode wherein when said first mode is designated, the external informing of the lack of paper is done immediately and, wherein, when the second mode is designated, the external informing of a lack of paper is delayed until a time necessary to start an actual paper feed from alternate paper feed means.

7. A printer controlling apparatus according to claim 6, wherein said inform means includes a display for displaying information on the lack of paper.

8. A printer controlling apparatus according to claim 6, wherein said inform means includes means for informing external equipment of the lack of paper.

9. A printer controlling apparatus according to claim 6, wherein said printer controlling apparatus includes control for electrographically printing.

10. A printer controlling apparatus according to claim 6, wherein a plurality of paper feed means are provided and a first, second and third mode can be set for each paper feed means.

11. A printing method comprising the steps of:

providing a plurality of paper feeding units for feeding paper;

detecting whether a paper is loaded in one of the paper feeding units;

externally transmitting information of a lack of paper in response to said detection;

accepting a designation of a first mode or a second mode;

storing the mode accepted; and controlling a printer in response to the detecting and mode storing steps so that when the first mode is stored, the external informing of the lack of paper is done immediately, and wherein, when the second mode is stored, the external informing of a lack of paper is delayed until a time necessary to start an actual paper feed from an alternate paper feeding unit.

12. A printing method according to claim 11, wherein external informing is done by means of a display.

13. A printing method according to claim 11, wherein external informing is made to external equipment.

14. A printing method according to claim 11, wherein the printing method results in electrophotographic printing.

15. A printing method according to claim 11, wherein a plurality of paper feeding units are provided and a first, second and third can be set for each of those units.

16. An apparatus comprising:

accepting means for accepting a designation of a recording medium or a designation of one of a plurality of medium setting means in which respective recording media are set;

discrimination means for discriminating, for each of the plurality of medium setting means, whether the medium setting means can supply the recording medium corresponding to the recording medium designation accepted by said accepting means;

priority setting means for providing the plurality of medium setting means with respective desired priorities; and selection means for selecting one of the plurality of medium setting means, wherein said selection means is operable in a first mode in which when at least two of the plurality of medium setting means can supply the recording medium corresponding to the accepted recording medium designation, one of the at least two medium setting means is selected which has the highest one of the priorities provided by said priority setting means, and operable in a second mode in which the one medium setting means is selected in response to the accepted medium setting means designation.

17. An apparatus according to claim 16, wherein said priority setting means includes means for storing information indicative of relation between the plurality of medium setting means and the priorities given thereto, and wherein at least one of the plurality of medium setting means may be provided with no priority.

18. An apparatus according to claim 16, further comprising means for controlling a display device to display information indicative of an absence of a designated recording medium, when said discrimination means shows that none of the plurality of medium setting means can supply the recording medium corresponding to the accepted designation.

19. An apparatus according to claim 16, further comprising dividing means for dividing the plurality of medium setting means into groups, wherein said priority setting means can provide the groups divided by said dividing means with respective desired priorities, and wherein when said discrimination means shows that at least two of the plurality of medium setting means can supply the recording medium corresponding to the accepted designation, said selection means selects one of the at least two medium setting means which has the highest one of the priorities provided by said priority setting means or one of the at least two medium setting means that is included in one of the divided groups which has the highest one of the priorities provided by said priority setting means.

20. An apparatus according to claim 19, further comprising second priority setting means for providing the medium setting means included in each divided group with respective desired priorities within the group, wherein said discrimination means shows that at least two of the plurality of medium setting means included in the one group which has the highest priority can supply the recording medium corresponding to the accepted designation, and said selection means selects one of the at least two medium setting means which has the highest one of the priorities within the one group provided by said second priority setting means.

21. An apparatus according to claim 16, wherein said priority setting means provide the respective desired properties in response to a user's operation or a command received from an external apparatus.

22. An apparatus according to claim 19, wherein said dividing means divides in response to a user's operation or a command received from an external apparatus.

23. An apparatus according to claim 19, wherein said second priority setting means provides the respective desired properties in response to a user's operation or a command received from an external apparatus.

24. An apparatus according to claim 16, further comprising means for forming an image on a recording medium set in the one recording medium selected by said selection means.

25. An apparatus according to claim 24, wherein said image forming means forms the image on the recording medium in an ink jet recording or in an electrophotographic recording.

26. An apparatus according to claim 24, wherein said apparatus comprises a printer, a facsimile apparatus, a copying apparatus or a combination thereof.

27. An apparatus comprising:

reception means for receiving print data from an external apparatus;

detection means for detecting whether a recording medium is set in medium setting means;

informing means for externally transmitting information of a lack of recording medium in response to detection by said detection means; and control means for controlling said informing means in a first mode to externally transmit the information of a lack of recording medium in response to the detection by said detection means, irrespective of whether said reception means has received print data to be printed on a recording medium, or in a second mode to externally transmit the information of a lack of recording medium in response to the detection by said detection means, after said reception means has received print data to be printed on the recording medium.

28. An apparatus according to claim 27, wherein said informing means includes a display for displaying information on a lack of recording medium.

29. An apparatus according to claim 27, wherein said informing means includes means for informing the external apparatus of a lack of recording medium.

30. An apparatus according to claim 27, further comprising a plurality of the medium setting means and mode setting means for setting either one of the first and second modes for each of said plurality of medium setting means.

31. An apparatus according to claim 27, further comprising a plurality of the medium setting means and selection means for selecting one of said plurality of medium setting means, wherein said control means controls said informing means either in the first and second modes to externally transmit the information of a lack of recording medium when said detection means detects a lack of recording medium in said one medium setting means selected by said selection means.

32. An apparatus according to claim 31, further comprising:

accepting means for accepting a designation of a recording medium;

discrimination means for discriminating, for each of said plurality of medium setting means, whether the medium setting means can supply the recording medium corresponding to the designation accepted by said accepting means; and priority setting means for providing said plurality of medium setting means with respective desired priorities, wherein said selection means is operable in a third mode in which when said discrimination means shows that at least two of said plurality of medium setting means can supply the recording medium corresponding to the accepted designation, one of said at least two medium setting means is selected which has the highest one of the priorities provided by said priority setting means.

33. An apparatus according to claim 32, wherein said accepting means can accept a designation of one of said plurality of medium setting means, and wherein said selection means is operable in fourth mode in which said one medium setting means is selected in response to the accepted designation.

34. An apparatus according to claim 31, further comprising means for forming an image on a recording medium set in said one recording medium selected by said selection means.

35. An apparatus according to claim 34, wherein said image forming means forms the image on the recording medium in an ink jet recording or in an electrophotographic recording.

36. An apparatus according to claim 34, wherein said apparatus comprises a printer, a facsimile apparatus, a copying apparatus or a combination thereof.

37. A method comprising the steps of:

accepting a designation of a recording medium or a designation of one of a plurality of medium setting means in which respective recording media are set;

discriminating, for each of the plurality of medium setting means, whether the medium setting means can supply the recording medium corresponding to the accepted recording medium designation;

providing the plurality of medium setting means with respective desired priorities; and selecting one of the plurality of medium setting means, wherein said selection step is operable in a first mode in which when at least two of the plurality of medium setting means can supply the recording medium corresponding to the accepted recording medium designation, one of the at least two medium setting means is selected which has the highest one of the provided priorities, and operable in a second mode in which the one medium setting means is selected in response to the accepted medium setting means designation.

38. A method according to claim 37, wherein the setting of priority includes storing information indicative of a relation between the plurality of medium setting means and the priorities given thereto, and wherein at least one of the plurality of medium setting means may be provided with no priority.

39. A method according to claim 37, further comprising the step of controlling a display device to display information indicative of an absence of a designated recording medium when the discrimination shows that none of the plurality of medium setting means can supply the recording medium corresponding to the accepted designation.

40. A method according to claim 37, further comprising the step of dividing the plurality of medium setting means into groups, wherein the setting of priority provides the groups divided by said dividing means with respective desired priorities, and wherein when the discrimination shows that at least two of the plurality of medium setting means can supply the recording medium corresponding to the accepted designation, said selection being one of the at least two medium setting means which has the highest one of the provided priorities or one of the at least two medium setting means that is included in one of the divided groups which has the highest one of the provided priorities.

41. A method according to claim 40, further comprising the step of providing the medium setting means included in each divided group with respective desired priorities within the group, wherein said discrimination shows that at least two of the plurality of medium setting means included in the one group which has the highest priority can supply the recording medium corresponding to the accepted designation, and said selection being one of the at least two medium setting means which has the highest one of the priorities within the one provided group.

42. A method according to claim 37, wherein the providing of priority is in response to a user's operation or a command received from an external apparatus.

43. A method according to claim 40, wherein the dividing is in response to a user's operation or a command received from an external apparatus.

44. A method according to claim 40, wherein said second setting of priority provides the respective desired properties in response to a user's operation or a command received from an external apparatus.

45. A method according to claim 37, further comprising the step of forming an image on a recording medium set in the one recording medium selected.

46. A method according to claim 45, wherein said image forming forms the image on the recording medium in one of an ink jet recording and an electrophotographic recording.

47. A method according to claim 45, wherein the method is carried out in a printer, a facsimile apparatus, a copying apparatus or a combination thereof.

48. A method comprising the steps of:

receiving print data from an external apparatus;

detecting whether a recording medium is set in medium setting means;

externally transmitting information of a lack of recording medium in response to the detection; and controlling said transmitting in a first mode to externally transmit the information of a lack of recording medium in response to the detection, irrespective of whether print data to be printed on a recording medium was received, or in a second mode to externally transmit the information of a lack of recording medium in response to the detection, after print data to be printed on the recording medium was received.

49. A method according to claim 48, wherein the transmitting step includes the step of displaying information on a lack of recording medium.

50. A method according to claim 49, wherein said transmitting step informs an external apparatus of a lack of recording medium.

51. A method according to claim 49, further comprising the step of setting either one of a first and a second mode for each of a plurality of medium setting means.

52. A method according to claim 49, further comprising the step of selecting one of a plurality of medium setting means, wherein the transmitting is in either one of the first and the second modes to externally transmit the information of a lack of recording medium when said detection is of a lack of recording medium in said one selected medium setting means.

53. A method according to claim 49, further comprising the steps of:

accepting a designation of a recording medium;

discrimination means for discriminating, for each of said plurality of medium setting means, whether the medium setting means can supply the recording medium corresponding to the accepted designation; and providing said plurality of medium setting means with respective desired priorities, wherein said selection is operable in a third mode in which when said discrimination shows that at least two of said plurality of medium setting means can supply the recording medium corresponding to the accepted designation, one of said at least two medium setting means which has the highest one of the provided priorities is selected.

54. A method according to claim 53, wherein a designation of one of said plurality of medium setting means is accepted, and wherein said selection is operable in fourth mode in which said one medium setting means is selected in response to the accepted designation.

55. A method according to claim 52, further comprising the step of forming an image on a recording medium set in said one selected recording medium.

56. A method according to claim 52, wherein said image forming forms the image on the recording medium in one of ink jet recording and electrophotographic recording.

57. A method according to claim 55, wherein the method is carried out in a printer, a facsimile apparatus, a copying apparatus or a combination thereof.

* * * * *

UNITED STATES PATENT AND TRADEMARK OFFICE

CERTIFICATE OF CORRECTION

PATENT NO. : 6,010,261

DATED : January 4, 2000

INVENTOR(S): SHINICHIRO MAEKAWA

It is certified that error appears in the above-identified patent and that said Letters Patent is hereby corrected as shown below:

COVER PAGE AT ITEM [57] ABSTRACT:
Line 6, "are" should read --is--; and
Line 12, "are" should read --is--.

SHEET 4:
Figure 4, "IMAGE MEORY" should read --IMAGE MEMORY--.

SHEET 11:
Figure 11, "IMAGE MEORY" should read --IMAGE MEMORY--.

COLUMN 1:
Line 24, "are" should read --is--; and
Line 41, "are" should read --is--.

COLUMN 2:
Line 54, "designates" should read --designate--.

COLUMN 3:
Line 65, "move" should read --moved--.

COLUMN 4:
Line 1, "to" should be deleted.

UNITED STATES PATENT AND TRADEMARK OFFICE

CERTIFICATE OF CORRECTION

PATENT NO. : 6,010,261

DATED : January 4, 2000

INVENTOR(S): SHINICHIRO MAEKAWA

It is certified that error appears in the above-identified patent and that said Letters Patent is hereby corrected as shown below:

COLUMN 7:

Line 10, "are" should read --is--;
Line 11, "are" should read --is--; and
Line 12, "are" should read --is--.

COLUMN 8:

Line 13, "ng" should read --n.g.--;
Line 17, "same" should read --the same--;
Line 22, "ng" should read --n.g.--;
Line 30, "ng" should read --n.g.--;
Line 34, "same" should read --the same--; and
Line 46, "to" (2nd occurrence) should be deleted.

COLUMN 9:

Line 56, "are lack of" should read --lack--.

UNITED STATES PATENT AND TRADEMARK OFFICE

CERTIFICATE OF CORRECTION

PATENT NO. : 6,010,261

DATED : January 4, 2000

INVENTOR(S): SHINICHIRO MAEKAWA

It is certified that error appears in the above-identified patent and that said Letters Patent is hereby corrected as shown below:

COLUMN 10:

Line 22, "are" should read --is--.

Signed and Sealed this

Twenty-sixth Day of December, 2000

*Attest:*

Q. TODD DICKINSON

*Attesting Officer*

*Director of Patents and Trademarks*